United States Patent [19]

Bofinger

[11] 3,980,279

[45] Sept. 14, 1976

[54] INTERLOCKING SYSTEM FOR ROADWAY TRAFFIC BARRIERS

[76] Inventor: Peter Bofinger, 11 Orlando Drive, Chadwick Beach, N.J. 08739

[22] Filed: May 9, 1974

[21] Appl. No.: 468,257

[30] Foreign Application Priority Data

June 19, 1973 Germany ..... 2331168

[52] U.S. Cl. ..... 256/13.1; 52/583; 52/587

[51] Int. Cl.[2] ..... E01F 15/00

[58] Field of Search ..... 256/13, 1; 52/587, 583, 52/594

[56] References Cited

UNITED STATES PATENTS

| | | | |
|---|---|---|---|
| 1,359,978 | 11/1920 | Folin | 52/710 X |
| 1,834,842 | 12/1931 | Houghtaling | 52/587 X |
| 3,092,371 | 6/1963 | Knudsen | 256/13.1 |

FOREIGN PATENTS OR APPLICATIONS

| | | | |
|---|---|---|---|
| 710,804 | 7/1966 | Italy | 256/13.1 |

*Primary Examiner*—Kenneth Downey
*Attorney, Agent, or Firm*—Allan Ratner

[57] ABSTRACT

An interlocking system for prefabricated roadway concrete barriers having a slot formed in an end of one barrier which defines a longitudinal and a transverse dimension. Another barrier has at least one member extending from an end with the member having a body portion and an end portion. The end portion is larger in the transverse dimension than the body portion. The slot forms an entranceway section for receiving through the entranceway of the member. The end portion is then captured in the slot within a section reduced in the transverse dimension.

13 Claims, 6 Drawing Figures

Fig.5
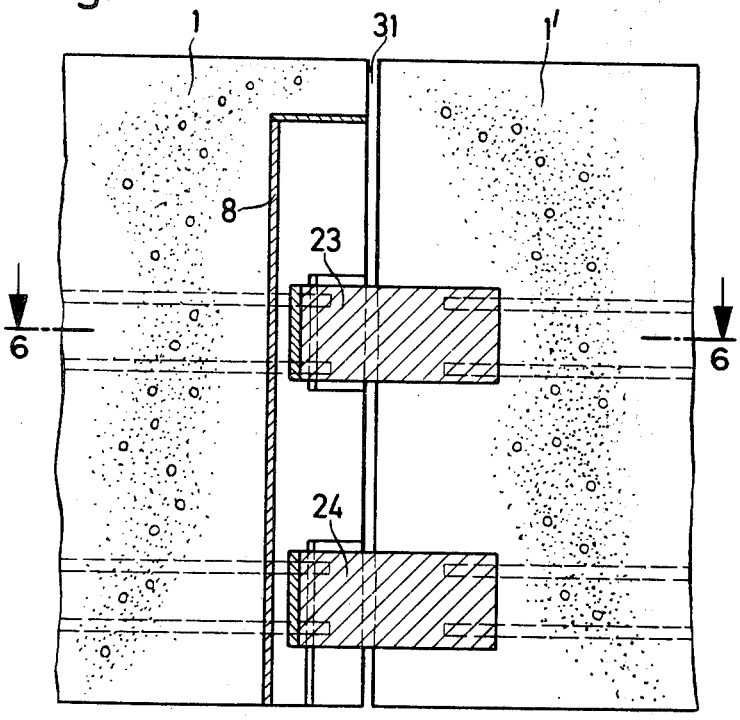
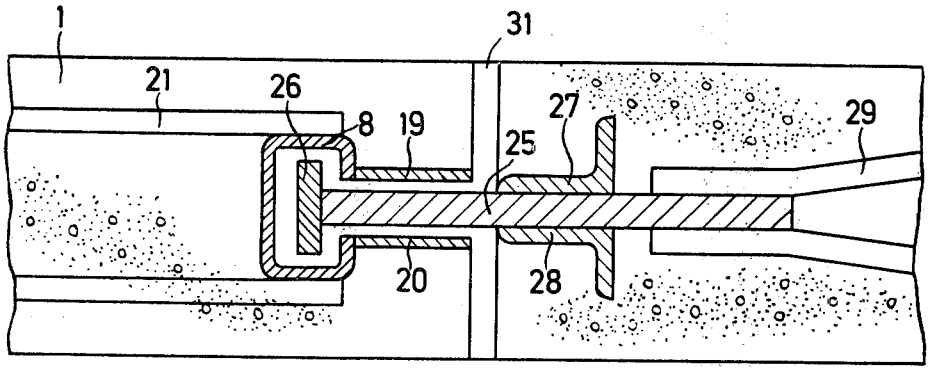
Fig.6

INTERLOCKING SYSTEM FOR ROADWAY TRAFFIC BARRIERS

BACKGROUND OF THE INVENTION

1. Field of the Invention

This invention relates to the field of roadway traffic barriers.

2. Prior Art

Traffic barriers are well known for use on roads as a boundary for traffic lanes. These traffic barriers have been in the past made of concrete and either cast in place or been prefabricated. These barriers may have a height comparable to the normal tire size of a passenger vehicle and may also be slightly higher. The barriers normally have a wise supporting base and extend upwardly in a trapezoidal shape to approximately half the height of the barrier. The side faces of the barrier then extend upwardly through a steeper slope forming the narrow head portion. These curves and slope faces have the function of reflecting a vehicle driven against the barrier back into the lane of traffic. These barriers may have an average height of approximately 85 cm. In some cases, in order to save material, only one side of the barrier has the foregoing shape while the backface opposite to the lane of traffic may be formed without the lower slope face.

It has been known to interlock such prefabricated concrete barriers by pouring concrete into the joints between the vertical end faces. Upon impact by a vehicle on one barrier, the tension forces are transferred to adjacent rigidly interlocked barriers. However, such rigid interlocking has the disadvantage of requiring poured in place concrete at the site. Filling the voids between the vertical end faces may take a considerable amount of time. Rigid interlocking has been found objectionable in that after a traffic accident in which the barriers are damaged, replacing the barriers may require expensive and time consuming procedures. Such procedures require a partial destruction of the barrier system.

As a substitute for the foregoing rigid interlocking system, it has been known to provide both ends of a prefabricated concrete barrier with hinge discs as described, for example, in German Pat. No. 1266785. In this system a hole matching a hinge disc is coupled to a hole attached to the top of a support to which the barriers are attached using bolts and nuts through the centered holes in the hinge discs. However, this system is objectionable when using the concrete barriers described above since the joints between barriers would be far too large. In addition, the bolts would be required to be oversized to transfer required amounts of tension forces between adjacent barriers when a barrier is impacted by a vehicle.

SUMMARY OF THE INVENTION

An interlocking system for a plurality of roadway traffic barriers having first locking means for one end of a first barrier. The female locking means for both ends of a first of the barriers including female slot means. Male locking means for both ends of a second of the barriers having at least one male member with a body and an end portion with the end portion being transversely larger than the body portion. Each of the female slot means having (1) at least one entranceway section for receiving the male member of an adjacent second barrier and (2) at least one transversely reduced section for capturing the male member end portion of the adjacent second barrier. Each female slot means having a longitudinally extending opening formed throughout a major portion of the longitudinal dimension of the first barrier and extending into and forming a bottom entranceway through opening through a bottom face. In this way there is provided a clear open passageway through the female slot means and out of the bottom entranceway for the adjacent second barrier male member when the first barrier is lifted upwardly for removal.

BRIEF DESCRIPTION OF THE DRAWINGS

FIGS. 4 & 5 show the second and third erection steps; and

FIG. 6 is a sectional view of the barriers of FIG. 5 taken along lines 6—6.

DESCRIPTION OF THE PREFERRED EMBODIMENT(S)

Figure 1:
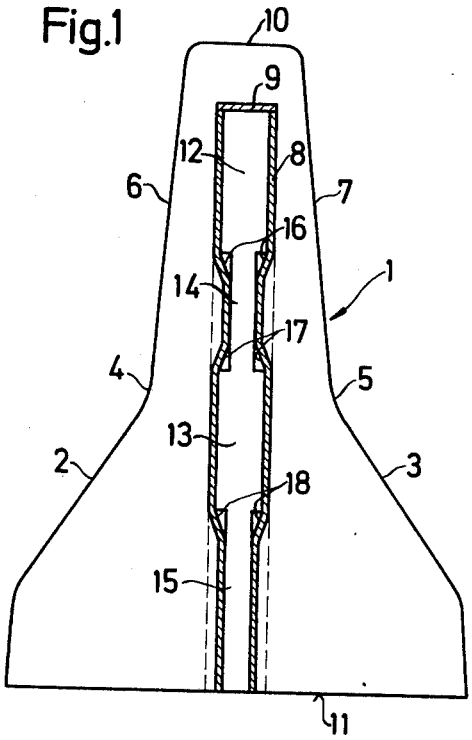
FIG. 1 is an end view of a concrete barrier showing the female locking means of the present invention.
Figure 2:
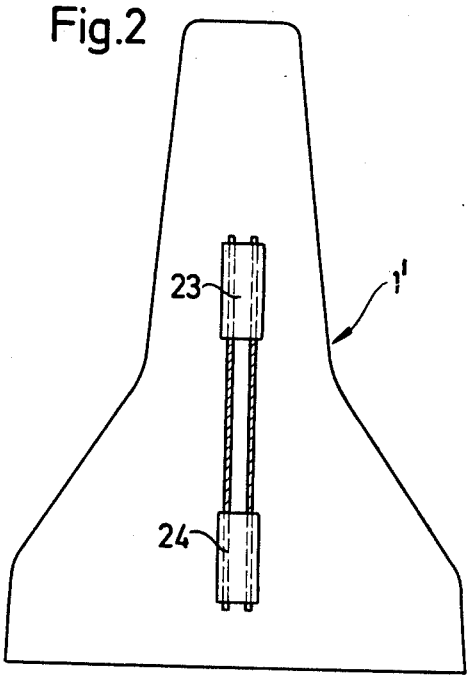
FIG. 2 is an end view of a concrete barrier showing the male locking means of the present invention.

Referring now to the drawings, barriers 1 and 1' are shown in vertical end views in FIGS. 1 and 2 respectively. The ends of the barriers have a comparatively wide base which reduces substantially conically to about mid-height. This forms sloped side faces 2 and 3 which continue upwardly through curves 4 and 5 and through steep side faces 6 and 7 to a comparatively narrow head of the barrier. Each of the barriers have an average height of 85 cm with an average base width of approximately 60 cm. The length of each of the barriers may vary and is governed by road conditions, etc.

Barrier 1 has formed at both ends female or first locking means both of which are identical and only one of which need be described in detail. As shown in FIGS. 1, 3–6, a rectangular structural tube 8 is cast into the end of barrier 1 and recessed from the end face. Tube 8 has a longitudinal or vertical dimension and a transverse or horizontal dimension. Tube 8 is shorter in the longitudinal dimension than the barrier height with the upper end of tube 8 covered by a welded plate 9 which is below the top face 10 of the barrier. The lower end of tube 8 is flush with and extends into the bottom face 11 of barrier 1. The wide flange of each structural tubing 8 is disposed parallel with the end faces of barrier 1 and forms a continuous slot from plate 9 to bottom face 11.

The slot is divided into two wider sections or entranceways 12 and 13 and two narrower (reduced in the transverse dimension) sections 14 and 15. At each transition between wider sections 12 and 13 and narrower sections 14 and 15, sloped guide faces 16–18 are provided. Two steel straps 19 and 20, as shown, are welded at the slot edges and to plate 9 at the upper end. These straps are flush with bottom base 11 of barrier 1. Steel straps 19 and 20 act as stiffeners for tubing 8. Two hair-pin shaped reinforcement bars 21 and 22 are welded to the narrow faces of each structural tubing 8 for better anchorage into concrete barrier 1. It will be understood, further reinforcement may be provided by additional reinforcement bars in conventional manner.

Identical male or second locking means are provided at each end of barrier 1′ and only one need be described in detail. The second locking means comprises two T-shaped locking members 23 and 24 extending from barrier 1′ end face and formed by welding plates 25 and 26. Plate 25 defines a body portion of the member while plate 26 defines an end portion or protuberance remote from barrier 1′. Locking members 23 and 24 are spaced in a longitudinal dimension corresponding to the distance between the wider sections 12 and 13. This spacing also corresponds with the distance between narrower sections 14 and 15. It is these narrower sections which are effective to capture end portions 26 of members 23 and 24 within tubing 8. It will be understood that the inner transverse dimension of wider sections 12 and 13 is substantially larger than each outer transverse dimension of end portion 26. However, the inner transverse dimension of sections 14 and 15 is substantially less than each outer transverse dimension of portion 26 (but substantially larger than the outer transverse dimension of body portion 25). Further, the inner transverse dimension of tubing 8 itself is substantially larger than each outer transverse dimension of portion 26.

Plates 25 of members 23 and 24 at each end of barrier 1′ are welded to steel angle iron 27 and 28. In addition, hair-pin shaped reinforcement bars 29 and 30 are welded to anchor plates 25 into the concrete barrier 1′.

Figure 3:
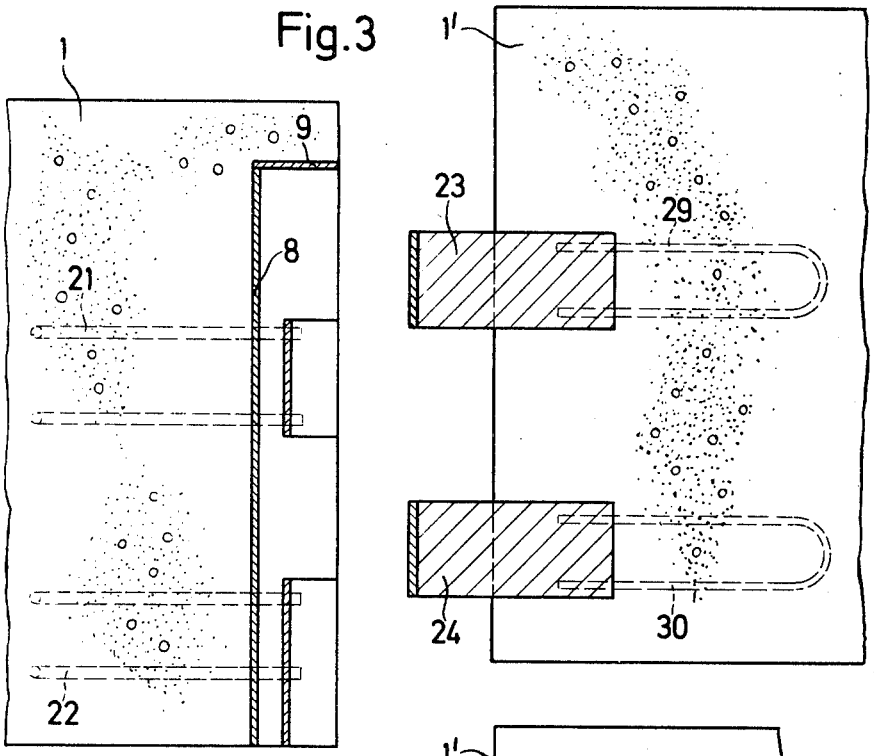
FIG. 3 is a longitudinal cross-section of two adjacent barrier ends showing a first step in the erection by joining the barrier of FIG. 2 with the barrier of FIG. 1 in which the barrier of FIG. 1 is resting on the roadway.
Figure 4:
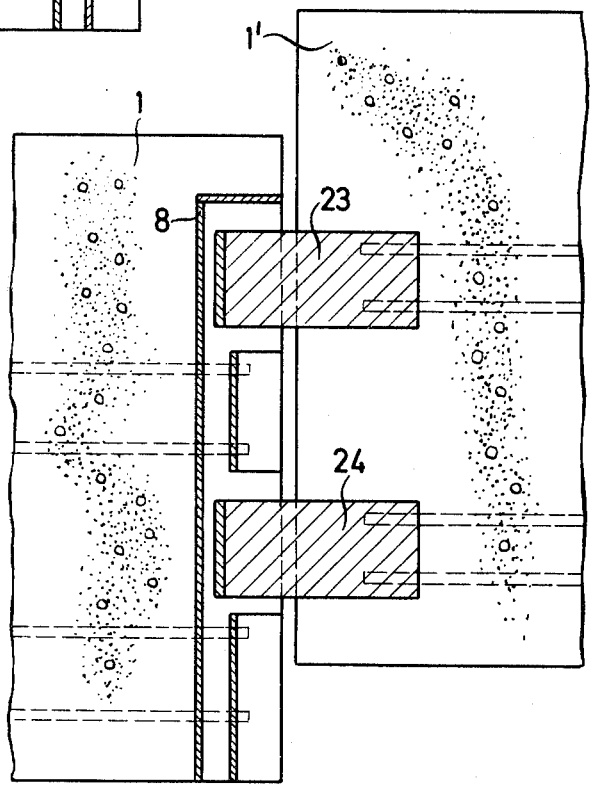

In the erection of the barrier system, barriers 1 and 1′ are alternately coupled together. Specifically, barrier 1 is first placed on the roadway. Barrier 1′ is then placed in position as shown in FIG. 3 by moving it towards the interlocking end face of barrier 1 in a slightly elevated position. As shown in FIG. 4, when members 23 and 24 are received through entranceway sections 12 and 13. Barrier 1′ is then lowered moving members 23 and 24 (assisted by the slope faces 16 and 18) in a bayonet like manner into the capturing recesses formed within tubing 8 by narrow sections 14 and 15. Thus, there is achieved a final encasement of the crosshead as shown in FIG. 5.

Barriers 1 and 1′ are now interlocked so that the next barrier 1 may be interlocked to the other end of barrier 1′. In order to interlock the next barrier 1 (having female locking means) it has been found best to proceed in a similar manner. Specifically, the next barrier 1 is moved in a slightly elevated position with entranceway 13 receiving member 23 and tubing 8 behind section 15 being above member 24. That barrier 1 is then lowered and members 23 and 24 are then captured in the capturing recesses formed within tubing 8 by sections 14 and 15 respectively. This procedure is simpler than the alternative in which the next barrier 1 is raised in a higher elevated position so that the entranceway formed by tubing 8 behind section 15 first receives member 23. The barrier 1 is then lowered until tubing 8 receives member 24 and full seating is achieved. It will be understood that in this latter procedure proper alignment is critical and therefore the prior slightly elevated position procedure may be preferable.

It will be understood that the space between the face of end portion 26 and the adjacent tubing may be larger than the spacing of joint 31 between the end faces of barriers 1 and 1′ as shown in FIG. 6. Joint 31 is an expansion joint which may be filled with flat filler material. This material may be applied, for example, to end face of barrier 1′ before erection.

Thus, it will now be understood that an interlock is achieved which enables in a very simple manner an extremely tight interlocking of concrete barriers. By using appropriate design layout of both interlocking parts, it is possible to keep the joints between adjoining barriers so small that the opposing end faces touch each other and therefore create a mutual supporting effect. It is in this way that a quasi-rigid interlock may be achieved. As previously described as a result of practical considerations, a flat filler may be applied to joint 31. This flat filler does not weaken the supporting effect since it is strong enough to transfer the impact forces through the interlocks to adjacent barriers when one barrier is hit by a vehicle.

In accordance with the invention, barriers may be exchanged without much difficulty. In a typical removal operation, first, a barrier 1 having female locking means is first removed by lifting the barrier upwardly and away. If further barriers are to be removed, the male members of the adjacent barrier may be disengaged by lifting a barrier 1′ slightly until the members are disengaged from the capturing recess and may be pulled out through the entranceway section.

It will be understood that the foregoing bayonet like action of the male and female members may be achieved by a different configuration of these locking parts with the corresponding adaption of entranceways and capturing recesses.

What is claimed is:

1. An interlocking system for a plurality of roadway traffic barriers comprising female locking means for both ends of a first of said barriers including female slot means having a longitudinal and a transverse dimension, male locking means for both ends of a second of said barriers having at least one male member having a body and an end portion, said end portion being larger than said body portion in said transverse dimension, and each said female slot means of a first barrier having (1) at least one entranceway section for receiving therethrough said male member of an adjacent second barrier and (2) at least one section reduced in the transverse dimension for capturing said male member end portion of said adjacent second barrier, each said female slot means having a longitudinally extending opening formed throughout a major portion of the longitudinal dimension of said first barrier and extending into and forming a bottom entranceway through opening through a bottom face of said first barrier to provide clear open passageway through said female slot means and out of said bottom entranceway for said adjacent second barrier male member when said first barrier is lifted upwardly for removal.

2. The interlocking system of claim 1 in which said reduced section of said female slot means (1) is in communication with said entranceway section, (2) is closer in the longitudinal dimension to said bottom face than said entranceway section and (3) is in the transverse dimension larger than said body portion and smaller than said end portion, whereby said end portion is captured within said longitudinally extending opening and said body portion is longitudinally movable with respect to said reduced section.

3. The interlocking system of claim 2 in which said female slot means forms with said reduced section a capturing recess.

4. The interlocking system of claim 3 in which said male locking means has two male members extending from both ends of said second barrier.

5. The interlocking system of claim 4 in which said slot means has (1) three entranceways for receiving therethrough a respective one of said members and (2) two sections reduced in the transverse dimension for forming two capturing recesses within said longitudinally extending opening for capturing said end portions of said two members.

6. The interlocking system of claim 4 in which said end portion of said member in the form of a protuberance.

7. The interlocking system of claim 4 in which said member is formed in the shape of a T.

8. The interlocking system of claim 1 in which said longitudinally extending opening comprises a rectangular structural tube of length less than the height of said first barrier and in which a longitudinally extending slot is formed along a face of said tube to provide said entranceways and reduced sections.

9. The interlocking system of claim 1 in which said female and male locking means of adjacent first and second barriers are separated by a flat filler to create a joint.

10. The interlocking system of claim 2 in which said longitudinally extending opening has a transverse dimension sufficient to receive said male member end portion and allow said first barrier to be pulled upwardly with said male member end portion passing entirely through said opening and out of said bottom entranceway whereby said barrier is removed from the roadway.

11. A barrier interlocking system for a plurality of roadway traffic barriers comprising female locking means for both ends of a first of said barriers including female slot means having a longitudinal and a transverse dimension, male locking means for both ends of a second of said barriers having a first and a second male member, each male member having a body and an end portion, the end portion of each member being larger than the respective body portion in said transverse dimension, and each said female slot means of a first barrier having (1) a first and a second entranceway section for respectively receiving therethrough said first and second male members of an adjacent second barrier and (2) a first and a second section reduced in the transverse dimension for capturing said end portions of said male members of said adjacent second barrier, each said female slot means having a longitudinally extending opening formed throughout a major portion of the longitudinal dimension of said first barrier and extending into and forming a bottom entranceway through opening through a bottom face of said first barrier to provide clear open passageway through said female slot means and out of said bottom entranceway for said adjacent second barrier male members when said first barrier is lifted upwardly for removal.

12. The barrier interlocking system of claim 11 in which said first and second reduced sections are each in the transverse dimension larger than a respective body portion and smaller than a respective end portion, whereby said end portions are captured within said longitudinally extending opening and said body portions are longitudinally movable with respect to said reduced sections.

13. The interlocking system of claim 12 in which said longitudinally extending opening has a transverse dimension sufficient to receive said end portions of said male members and allow said first barrier to be pulled upwardly with said male member end portions passing entirely through said opening and out of said bottom entranceway whereby said barrier is removed from the roadway.

* * * * *